US005713295A

United States Patent [19]

Bridge et al.

[11] Patent Number: 5,713,295

[45] Date of Patent: Feb. 3, 1998

[54] RUDDER SYSTEM FOR SELF-PROPELLED WATER CRAFT

[75] Inventors: Andrew R. Bridge; Anthony E. Lee, both of Harriman; Charles S. Scarborough, Rockwood, all of Tenn.

[73] Assignee: Dagger, Inc., Harriman, Tenn.

[21] Appl. No.: 751,348

[22] Filed: Nov. 19, 1996

[51] Int. Cl.[6] ..... B63H 25/00

[52] U.S. Cl. ..... 114/153; 114/162; 114/347

[58] Field of Search ..... 114/144 R, 153, 114/162, 343, 347; 440/6, 7

[56] References Cited

U.S. PATENT DOCUMENTS

| | | | |
|---|---|---|---|
| 2,631,559 | 3/1953 | Jones | 114/153 |
| 4,556,006 | 12/1985 | Kaupat | 114/347 |
| 4,646,669 | 3/1987 | Frank | 114/347 |
| 5,460,551 | 10/1995 | Beres | 114/347 |

*Primary Examiner*—Stephen Avila
*Attorney, Agent, or Firm*—Pitts & Brittian, P.C.

[57] ABSTRACT

A rudder assembly for self-propelled water craft, and particularly for a touring kayak. A rudder member is positioned within a notch of the rear of the keel of the craft, the exterior contour of this rudder member is made to augment the contour of the rest of the kayak hull to minimize changing the pattern of water flow around the craft. The rudder member is moved using an upstanding shaft attached to a disk within a recess in the rear of the craft, this disk being provided with starboard and port cables that extend to the cockpit of the craft. Axial movement of the cables is achieved using left and right foot pedals attached to slides within fixed channels. Provision is made for the adjustment of length of the cables, and for releasably locking one or both against axial movement.

15 Claims, 5 Drawing Sheets

RUDDER SYSTEM FOR SELF-PROPELLED WATER CRAFT

TECHNICAL FIELD

The present invention relates to systems for controlling the direction of movement of water craft, and more particularly to a rudder system for self-propelled water craft such as kayaks and canoes.

BACKGROUND ART

While the term "self-propelled" might be applied to several types of water craft, it generally refers to canoes and kayaks. Both are propelled by an operator using paddles. Within these categories, generally only "touring" kayaks are provided with rudder mechanisms. The kayaks that are so equipped conventionally have one of two different types of rudder systems. In one, a rudder assembly is supported at the extreme stern of the craft in a pivotal manner. The rudder itself is plate-like in configuration. Operation of this rudder is controlled by cables that are positioned along the exterior of the craft and extend to the position of a cockpit for the user. These cables are manipulated by the hands of the user. In some installations, a further cable extending along the surface of the craft permits the user to pivotally raise the rudder assembly so as to lift the rudder above the water as when it is not needed or during removal and/or transport of the craft.

Another typical construction of a rudder system for kayaks, for example, is the mounting of a flat rudder plate within a notch created at the rear of the keel of the craft. It is supported by a hinge member at the forward edge of the notch. Arms projecting on each side of the rudder provide for the attachment of cables similar to those described above that extend along the craft surface to the cockpit for hand manipulation by the user.

These rudder systems have several drawbacks. For example, the control cables exterior the hull give rise to potential damage during use or transport. Debris can accumulate, and the cables interfere with storage of equipment on the surface of, or being stored within, the craft. Further, during periods of propulsion of the craft with a paddle, these cables cannot be operated. In addition, neither of the conventional rudder systems augments the contour of the craft to optimize movement through the water.

Accordingly, it is an object of the present invention to provide a rudder system for self-propelled water craft that has a rudder that augments the contour of the craft so as to optimize movement of the craft through the water.

It is another object of the present invention to provide a rudder system that can be continuously operated, if desired, during the paddling of the craft.

Still another object of the present invention is to provide a rudder system wherein operating cables for the rudder are within the craft to minimize interference with the storing of gear within the craft and upon the surface thereof.

These and other objects of the present invention will become apparent upon a consideration of the drawings referred to hereinafter, and a complete description thereof.

SUMMARY OF THE INVENTION

In accordance with the present invention, there is provided a rudder assembly for self-propelled water craft that meets the above-identified objects. Specifically, there is a rudder member positioned within a notch at the rear of the keel of the craft, this rudder member having an exterior surface contour that augments the contour of the craft. This minimizes any drag and therefore optimizes movement of the craft through the water. The rudder member is provided with a shaft that extends upwardly into a small compartment at the stern of the craft where it is releasable attached to an operating disk. Cables are attached to starboard and port locations on this operating disk and extend within the hull of the craft to the cockpit thereof. Within the cockpit the cables terminate at slidable foot-operated pedals. The length of these cables is adjustable, and they can be locked in a selected position to maintain the position of the rudder member stationary during manipulation of the paddles by the craft user if desired. In a preferred construction, the cables within the cockpit are attached to belts that provide the adjustment and locking features.

BEST MODE FOR CARRYING OUT THE INVENTION

Figure 1:
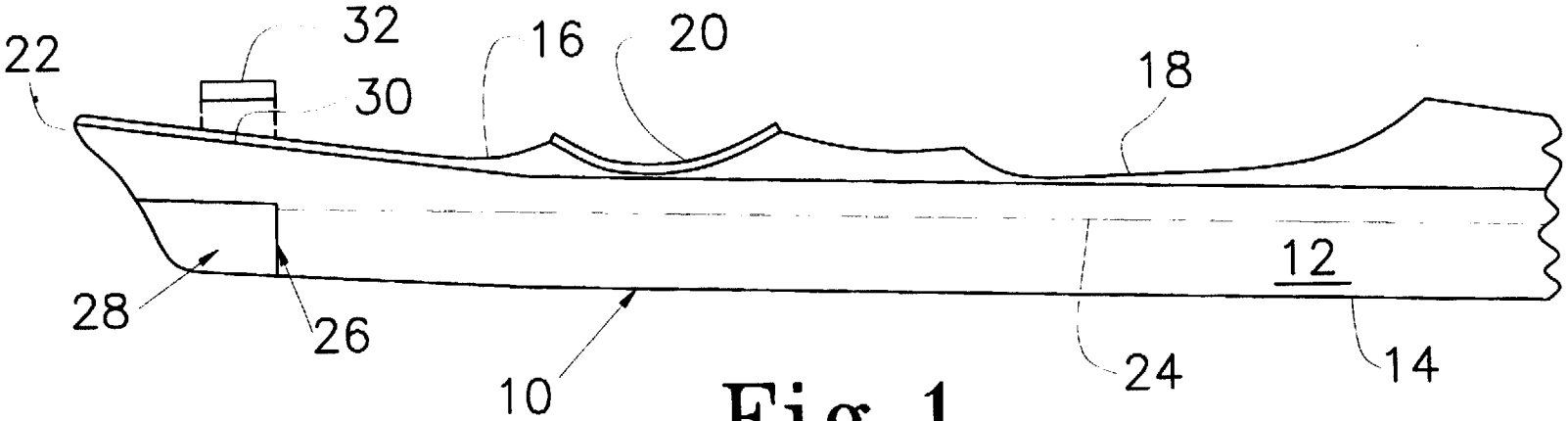
FIG. 1 is a partial side elevation of a kayak utilizing the rudder system of the present invention.
Figure 2:
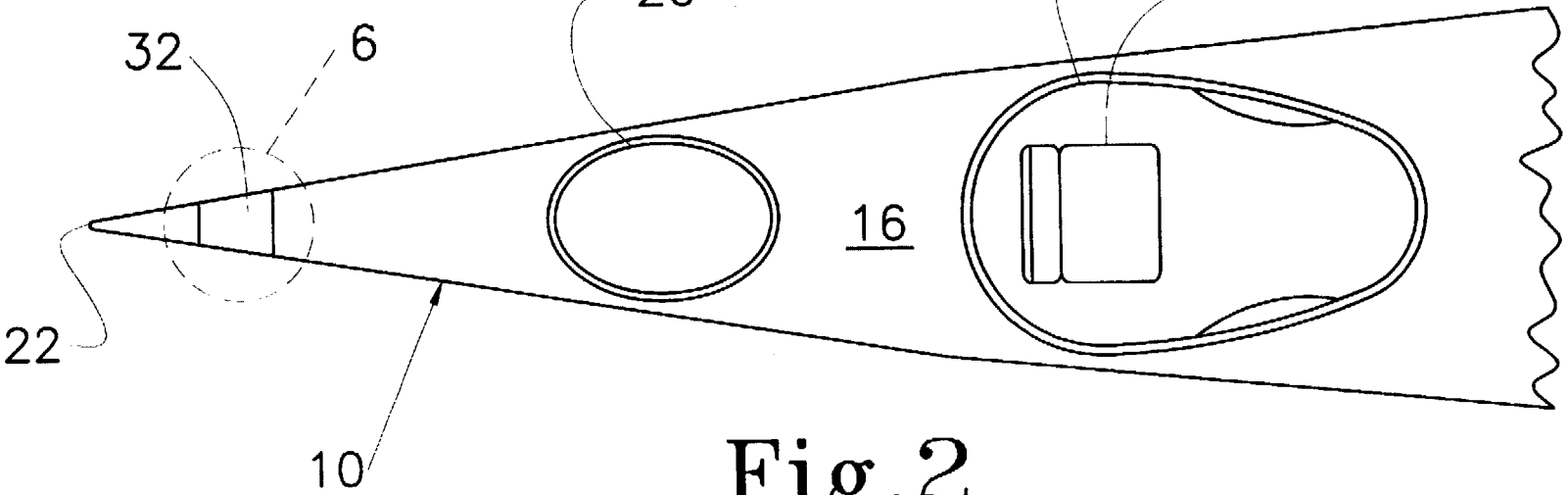
FIG. 2 is a partial top or plan view of the kayak of FIG. 1.

The present invention will be best understood by reference to the various figures referred to above. FIGS. 1 and 2, for example, illustrate the exterior appearance of a typical touring kayak 10, the craft for which the present rudder system is particularly adapted. This kayak is formed with a hull 12, having a keel 14, and a deck 16. The deck 16 typically is provided with at least one cockpit region 18, containing a seat 19, and one or more storage access hatches as at 20. It will be understood that the cockpit region 18, nor the storage access 20, need to be so definitely defined as shown in these figures. The kayak 10 has a stern end 22, and a bow (not shown). A typical water line is indicated at 24.

A notch 26 is provided at the stern end of the keel 14, this notch 26 receiving a rudder member 28. Details of this notch 26 and rudder member 28 are given in FIGS. 3–5. The deck 16 is provided with an opening into a rudder control cavity 30, and a cover 32 is provided for that cavity 30. This cavity 30 is described in detail in conjunction with FIGS. 6 and 7.

Figure 3:
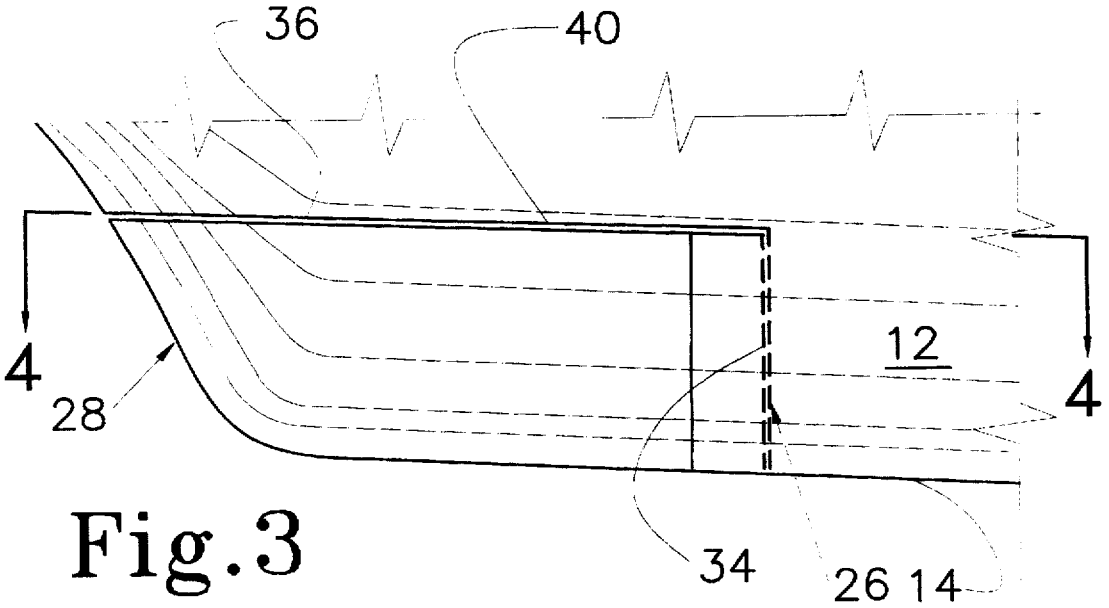
FIG. 3 is an enlarged view of the rudder member of the kayak of FIG. 1.
Figure 4:
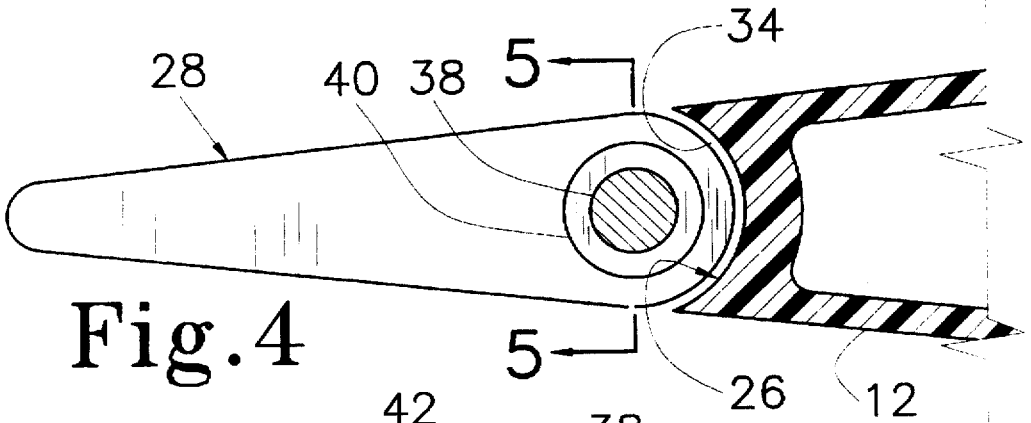
FIG. 4 is a top view of the rudder member of FIG. 3 taken at 4—4 thereof.
Figure 5:
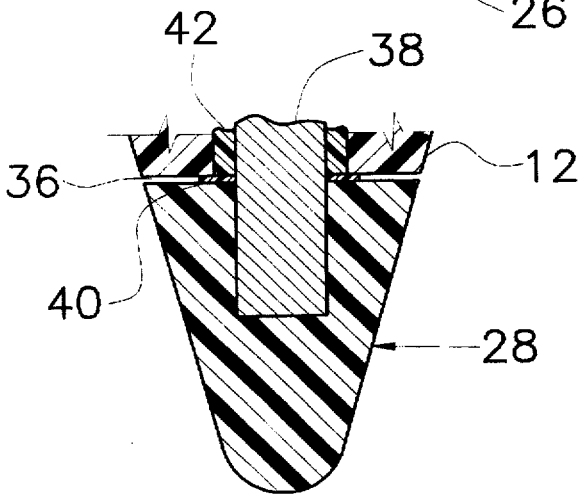
FIG. 5 is a cross-sectional view of the rudder member of FIG. 3 taken at 5—5 of FIG. 4.

The rudder member 28 is shown in greater detail in FIGS. 3–5. In FIG. 3, for example, the notch 26 in the keel 14 is shown to have a vertical portion 34 and a horizontal portion 36. Both portions are dimensioned to minimize collection of sand/grit between the notch 26 and the rudder member 28.

In FIG. 4 it is seen that the vertical portion 34 of the notch 26 is partially semi-cylindrical. This permits the rudder member 28 to be pivoted via a rotation of a shaft 38. Surrounding this shaft 38 is a spacer 40 to maintain the gap of the horizontal portion 36 of the notch 26 to prevent binding of the rudder member 28. In FIG. 5, it can be seen that this shaft 38 passes through a sleeve 42 of a non-galling material (e.g., a plastic) into the hull 12. It can be seen in FIGS. 3–5 that the exterior contour of the rudder member 26 is a continuation of (i.e., augments) the contour of the hull 12. As such, there is a minimum disturbance (e.g. turbulence) caused by the rudder member 26 of water flow around the craft 10.

Figure 6:
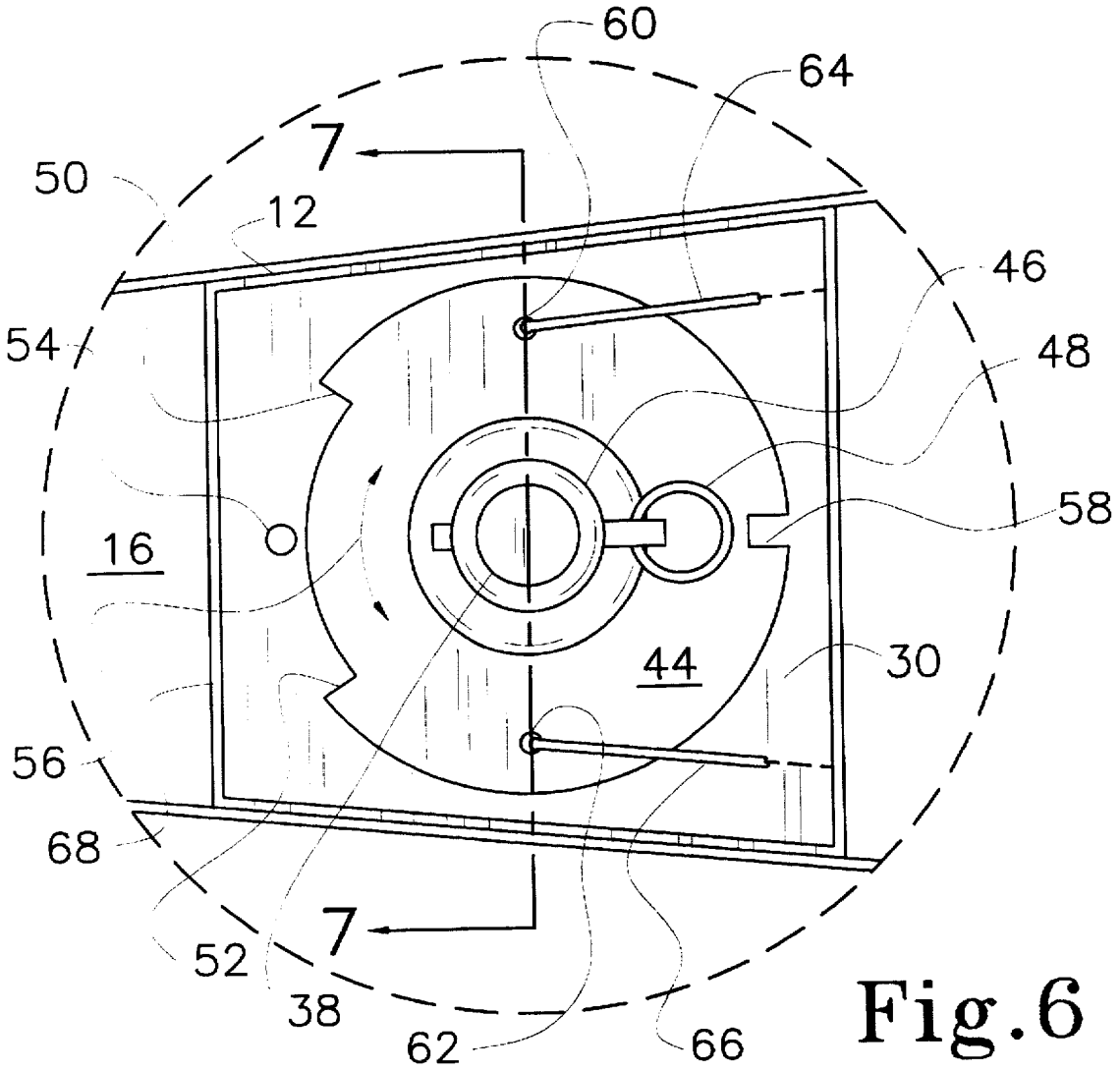
FIG. 6 is top view of the operating portion of the rudder system of FIGS. 1 and 3, this view area being taken at 6 of FIG. 1.
Figure 7:
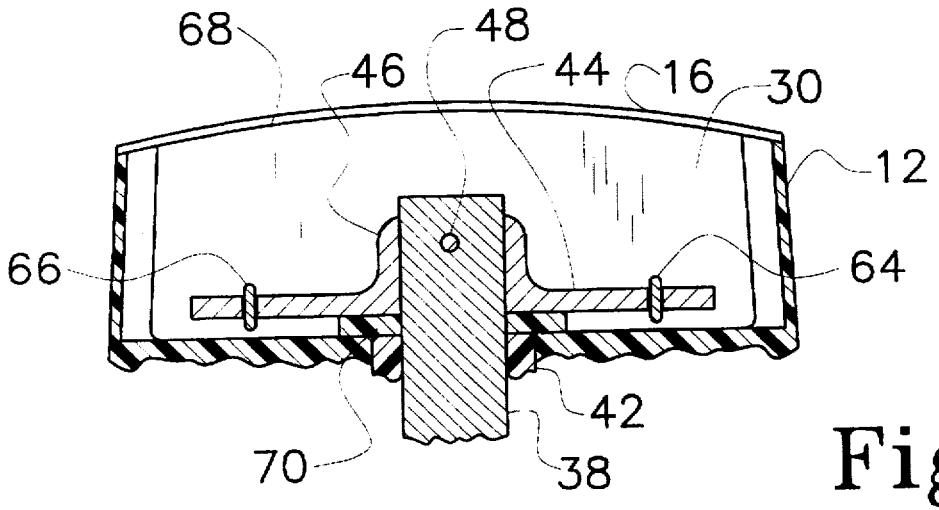
FIG. 7 is a cross-sectional view of the operating portion of FIG. 6 taken at 7—7 thereof.

Details of a preferred control means for the rudder member are shown in FIGS. 6 and 7. Mounted within the cavity 30 at the stern of the craft is an operator disk 44. This disk 44 has an upstanding sleeve 46 surrounding the shaft 38. A ring pin unit 48 passes through this sleeve 46 and the shaft 38 thereby permitting a separation of the components for the removal of either from the cavity 30. With the pin unit 48 in place as shown, the shaft 38 and the operator disk 44 turn in unison. Further, as the operator disk 44 rotates around the center of the shaft 38, the rudder member 28 is rotated.

The operator disk 44 is provided with a peripheral notch such that two shoulders 50, 52 are produced. Positioned within the cavity 30 at a position to be engaged by one of the shoulders 50, 52 is an upright pin 54 whereby rotation of the operator disk 44 in the directions indicated by the double ended arrow 56 is limited upon contact of one of the shoulders 50, 52 with the pin 54. A second notch 58 in the operator disk 44 can be provided for receiving a locking member (not shown in this FIG. 6, see FIG. 9) whenever the rudder member 28 is to be locked in a central position (as in FIG. 4) during transport, for example.

A pair of diametrically-positioned starboard and port holes 60, 62 are provided proximate the periphery of the operator disk 44. These holes provide for the attachment of control cables 64, 66 leading interior the craft hull 12 to the region of the seat 19 within the cockpit 18. It will be understood that these cables 64, 66 could be attached by other means to the operator disk 44. Such attachment, however, should provide for pivotal movement. These FIGS. 6 and 7 illustrate a shoulder 68 against which the cover 32 (see FIG. 1) rests when applied. Pivotal fasteners (not shown) on the deck 16 typically hold the cover 32 in place so as match the contour of the deck 16. Further, as seen in FIG. 6, there is a thrust bearing member 70 surrounding the shaft 38 interposed between the operator disk 44 and the base of the cavity to prevent frictional engagement of the operator disk 44.

Figure 8:
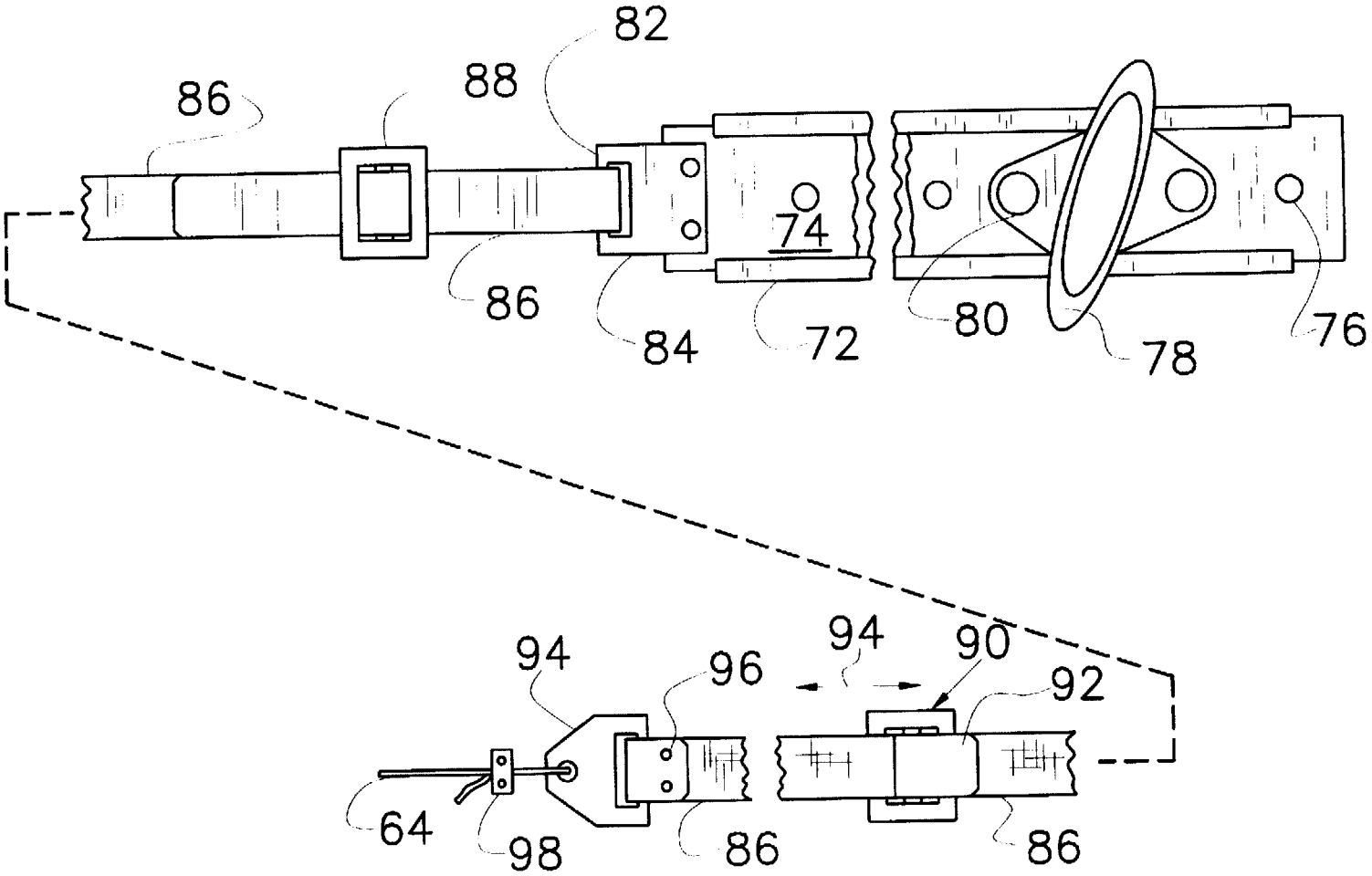
FIG. 8 is a drawing illustrating the control portion of the rudder system of the present invention, this control portion being mounted within the cockpit region of the kayak.

A preferred construction of apparatus to effect axial movement of the cables 64, 66 is illustrated in FIG. 8. In particular, this is illustrated for the port side of the craft 10. A track 72 is attached, by any suitable means, to the interior of the hull 12 just forward of the seat 19 in the cockpit 18. Slidably positioned within this track 72 is a slide member 74. This slide member 74 typically is provided with numerous apertures 76 for the selective positioning of a foot pedal 78 using fasteners 80.

Attached to a rearward end 82 of the slide member 74, as with a bracket 84, is a strap 86. This strap 86 is doubled back through a buckle 88 whereby the length of the strap 86 can be adjusted. The principal feature of this length adjustment will be discussed below. The strap 86 continues toward the stern of the craft 10 and passes through a strap clamp unit 90 which is attached to the interior surface of the hull 12 by any suitable means. This strap clamp unit 90 has a pivotal clamp 92 which either engages the strap 86 to prevent axial movement in a direction indicated by the double ended arrow 94, or is disengaged from the strap 86 permitting axial movement. The rear end of the strap 86 is attached to a terminal member 94 as with rivets 96. The aforementioned-mentioned cable 64 is attached to this terminal member 94 as with a clamp 98. The combination of cables and straps is referred to as a "cable member".

Figure 9:
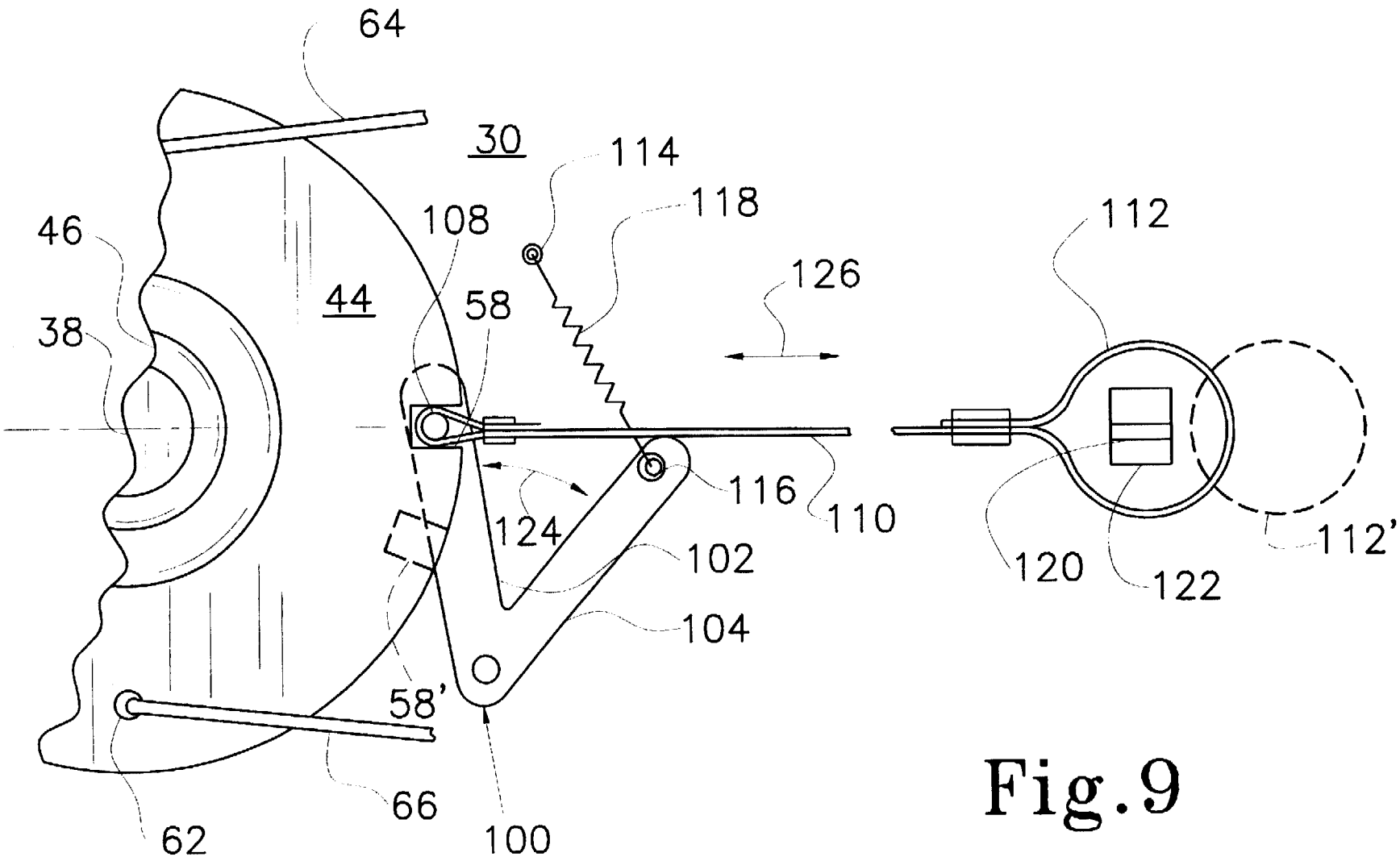
FIG. 9 is a drawing illustrating one embodiment of a system for locking the rudder member of FIGS. 2–5 in a fixed position as may be needed during transport of the water craft.

In a description of FIG. 6, the operator disk 44 was said to have a second notch 58 to receive a locking element if desired. One embodiment of a locking element structure is illustrated in FIG. 9. For simplicity, no water craft structure is shown, although the base of the cavity 30 is identified. An "L"-shaped bracket 100 has a pair of legs 102, 104. This bracket 100 is provided with a pivot 106 passing through the junction of the legs into the base of cavity 30. Leg 102 carries at its distal end a pin 108 to engage the notch 58. A cable member 110 is attached to this pin 108 that passes through the interior of the water craft to a location proximate the craft cockpit. At that point there is provided an element for grasp by a user; in this embodiment a ring-shaped element 112. A spring anchor 14 affixed to the base of the cavity 30, and a second spring anchor 116 carried by the distal end of leg 104, jointly support a spring member 118. Action of this spring member 118 causes the pin 108 to normally remain engaged with notch 58 when the position of the rudder member 28 is to be locked in a "neutral" position as illustrated in FIG. 4. However, when a user pulls axially on the ring-shaped element 112, the bracket 100 is caused to pivot to disengage the pin 108 from the notch 58. In this condition, the operator disk 44 is free to be rotated by the cables 64, 66. This withdrawn position of the pin 108 can be maintained, for example, by causing the cable 110 to engage a slot 120 in a fixed mount 122 where the ring-shaped element 112 is retained as indicated by the dashed line 112'. Of course, other retaining means for the cable 110 can be utilized. Pivotal motion of the bracket 100 is indicated by the double-ended arrow 124, and axial movement of the cable 110 is indicated by the double-ended arrow 126. The locked position with the pin 108 engaged with the notch 58 typically would be used during transport of the water craft; however, it could be used during certain operational conditions of the water craft. Of course, additional second notches, such as indicated at 58' could be utilized to fix the rotational position of the operator disk 44. This locking capability augments the locking capability described in conjunction with FIG. 8.

In a normal operation of the rudder system, with the components assembled as indicated in the Figures. The foot pedals 78 are positioned to accommodate a particular user's legs. With the rudder member 28 in a central orientation, the foot pedal 78 and its counterpart starboard foot pedal (not shown) will be generally at the same distance from the seat 19. This positioning is accomplished by the proper positioning of the foot pedal(s) 78 on the slide(s) 74 and by the adjustment of the length of the strap 86 using the buckle 88. Motion of the rudder member 28 is achieved by operation of the foot pedal(s) 78 by the feet of a user. Should a position of the rudder member 28 want to be maintained for an extended time period, as when encountering a cross wind, the strap 86 can be restrained using the clamp unit 90. The strap 86 on only one side of the craft needs to be restrained, although both can be restrained. Then if desired for the comfort of the user, the strap lengths can be adjusted with the buckle 88 so as to place the two foot pedals at about the same location on both sides of the craft 10. With the strap 86 thus locked against axial movement, a user can devote full time to propulsion of the craft.

From the foregoing, it will be understood by persons skilled in the art that an improved rudder system for self-propelled water craft has been provided. Full adjustment can be made, and a minimum of water flow disturbance occurs due to the contour of the rudder member. All controls are within the craft for convenient operation by a user of the craft.

Further, while particular configurations of components are used to described the water craft and its rudder system, these are not for the purpose of limiting the invention. Rather, it will be understood that the present invention is limited only by the content of the appended claims and their equivalents.

We claim:

1. A rudder system for self-propelled water craft, said craft having a hull of selected contour for contact with the water, said craft having a cockpit region to receive a user, said craft being provided with a notch at a rear end of a keel, said rudder system comprising:

a rudder member received in the notch, said rudder member having an exterior surface having a contour to augment the selected contour of the craft;

a shaft having a lower end attached to said rudder member and an upper end extending into the hull of the craft;

an operator disk positioned within the hull of the craft, said operator disk releasably attached to said upper end of said shaft;

a pair of cable members, each having a terminal end attached to opposite sides of said operator disk, and distal ends extending to the cockpit region;

a pair of reciprocal foot pedal assemblies within said cockpit region on opposite sides of said hull, with said distal ends of said cable members attached to respective of said foot pedal assemblies;

means for adjusting lengths of said cable members; and means for releasably restraining axial movement of said cable members.

2. The rudder assembly of claim 1 wherein each of said foot pedal assemblies comprises:

a track mounted substantially horizontally upon an interior wall of said hull;

a slide member positioned and moveable within said track, said slide member having a rearward end; and a foot pedal attached at a selected position along said slide member.

3. The rudder system of claim 2 wherein said cable member comprises:

a strap member engaged with said rearward end of said slide member; and a cable joining said strap member to said control disk.

4. The rudder system of claim 1 wherein said control disk is provided with a peripheral relieved portion to define a pair of shoulders, and further comprises a fixed pin mounted in the hull to cooperate with said relieved portion whereby contact of said shoulders with said fixed pin limits rotation of said control disk.

5. The rudder system of claim 3 wherein said strap member passes through a buckle for the adjustment of length of said strap member, and through a clamp member to releasably prevent axial movement of said strap member.

6. The rudder system of claim 1 wherein a removable pin connects said control disk to said upper end of said shaft for releasably connecting said shaft and said control disk.

7. The rudder system of claim 1 wherein said shaft is supported within a sleeve in said hull.

8. A rudder system for self-propelled water craft, said craft having a hull of selected contour for contact with the water, the craft having a cockpit region to receive a user, the craft being provided with a notch at a rear end of a keel of the hull, said rudder system comprising:

a rudder member received in the notch, said rudder member having an exterior surface having a contour to augment the selected contour of the craft;

a shaft having a lower end attached to said rudder member and an upper end extending into the hull of the craft;

a sleeve within said hull for supporting said shaft;

an operator disk positioned within the hull of the craft, said operator disk releasably attached to said upper end of said shaft with a removable pin;

a pair of cable members, each having a terminal end attached to opposite sides of said operator disk, and distal ends extending to the cockpit region;

a pair of substantially horizontal track members, each mounted on opposite sides of an inside surface of the hull proximate the cockpit region;

a slide member within each of said track members, a rear end of said slide member attached to said distal ends of said cable members;

a foot pedal attached to each of said slide members;

means for adjusting lengths of said cable members; and means for releasably restraining axial movement of said cable members.

9. The rudder system of claim 8 wherein each of said cable members comprises:

a strap member threaded through a slot in said slide member; and a cable joining said strap member to said control disk.

10. The rudder system of claim 9 wherein said strap member passes through a buckle for the adjustment of length of said strap member, and through a clamp member to releasably prevent axial movement of said strap member.

11. The rudder system of claim 8 wherein said control disk is provided with a peripheral relieved portion to define a pair of shoulders, and further comprises a fixed pin mounted in the hull to cooperate with said relieved portion whereby contact of said shoulders with said fixed pin limits rotation of said control disk.

12. A rudder system for self-propelled water craft, said craft having a hull of selected contour for contact with the water, the craft having a cockpit region to receive a user, the craft being provided with a notch at a rear end of a keel of the hull, the notch having a vertical portion and a horizontal portion, said rudder system comprising:

a rudder member received in the notch, said rudder member having an exterior surface having a contour to augment the selected contour of the craft;

a shaft having a lower end attached to said rudder member and an upper end extending into the hull of the craft;

a sleeve within said hull for supporting said shaft;

a rotatable operator disk positioned within the hull of the craft, said operator disk releasably attached to said upper end of said shaft with a removable pin;

a pair of cables, each having a terminal end attached to opposite sides of said operator disk, and distal ends extending to the cockpit region;

a pair of substantially horizontal track members, each mounted on opposite sides of an inside surface of the hull proximate the cockpit region;

a slide member within each of said track members, a rear end of said slide member attached to said distal ends of said cable members;

a foot pedal attached to each of said slide members;

a strap member threaded through a slot in each said slide member, a distal end of said strap member attached to said distal end of said cable from said control disk;

means for adjusting lengths of said strap members; and means for releasably restraining axial movement of said strap members.

13. The rudder system of claim 12 wherein the vertical portion of the notch is a concave semi-cylindrical surface, and wherein said rudder member has a forward-facing end having a convex surface matching the concave semi-cylindrical surface of the notch.

14. The rudder system of claim 12 wherein said control disk is provided with a peripheral relieved portion to define a pair of shoulders, and further comprises a fixed pin mounted in the hull to cooperate with said relieved portion whereby contact of said shoulders with said fixed pin limits rotation of said control disk.

15. The rudder system of claim 12 wherein said control disk is provided with a detent notch diametrically opposite said relieved portion, and further comprises a locking member and operator means for said locking member for moving said locking member into and out of engagement with said detent notch to lock and unlock said control disk for rotation about said shaft.

* * * * *